US005259305A

United States Patent [19]

Korb

[11] Patent Number: 5,259,305

[45] Date of Patent: Nov. 9, 1993

[54] WORK TABLE OR OFFICE DESK

[75] Inventor: Daniel Korb, Sindelfingen, Fed. Rep. of Germany

[73] Assignee: Dyes GmbH Büromöbelwerk, Fed. Rep. of Germany

[21] Appl. No.: 917,887

[22] Filed: Jul. 21, 1992

[30] Foreign Application Priority Data

Jul. 27, 1991 [DE] Fed. Rep. of Germany ..... 4124954

[51] Int. Cl.[5] ..... A47B 3/00

[52] U.S. Cl. ..... 108/129; 108/132

[58] Field of Search ..... 108/12, 19, 127, 124, 108/131, 132, 115, 116, 117; 248/108.6, 439

[56] References Cited

U.S. PATENT DOCUMENTS

| | | | |
|---|---|---|---|
| 493,021 | 3/1893 | Franks | 108/132 |
| 2,144,049 | 1/1939 | Forcier | 108/132 X |
| 2,873,987 | 2/1959 | Carson | 108/115 X |
| 3,267,886 | 8/1966 | Glass | 108/132 X |
| 3,695,567 | 10/1972 | Weagle | 108/132 X |
| 4,838,177 | 6/1989 | Vander Park | 108/52 X |
| 4,884,513 | 12/1989 | Newhouse et al. | 108/50 |

FOREIGN PATENT DOCUMENTS

| | | |
|---|---|---|
| 3300647 | 6/1987 | Fed. Rep. of Germany . |
| 3933237 | 11/1991 | Fed. Rep. of Germany . |

*Primary Examiner*—Jose V. Chen

*Attorney, Agent, or Firm*—Speckman, Pauley & Fejer

[57] ABSTRACT

A work table or office desk with a frame and a work surface supported by the frame, where the frame has a horizontal crosspiece, the ends of which are connected with each one of a table leg having base element. The table legs are fastened by simple structure to the crosspiece in such a way that it is possible to bring them from a space-saving storage position into a stable position of use with only a small assembly effort.

10 Claims, 3 Drawing Sheets

WORK TABLE OR OFFICE DESK

BACKGROUND OF THE INVENTION

1. Field of the Invention

This invention relates to a work table or office desk with a frame and a work surface supported by the frame, where the frame has a horizontal crosspiece, the ends of which are connected with each one of a table leg which has a base element.

2. Description of Prior Art

A work table or office desk of this type is known from German Patent Disclosure DE 39 33 327 A. In this disclosure, the table legs are fixedly connected with the crosspiece and, depending on the material used, glued or welded to it. For this reason, the work table or office desk remains in its bulky assembled position which requires considerable space for storage and moving.

Work table or office desk kits are also already known, as shown in German Patent Disclosure DE 33 00 647 C2. The disassembled parts of the work table or office desk are stored and transported in a space-saving manner. However, this requires considerable assembly efforts at their place of use and special workers are needed for this.

SUMMARY OF THE INVENTION

It is one object of this invention to provide a work table or office desk of the above mentioned type which can be stored and transported in a space-saving manner, but only requires simple assembly at its point of use, which can be performed by a non-specialist.

This object is achieved in accordance with this invention in that the upper ends of the table legs facing the crosspiece are each fixedly connected with a connecting element extending perpendicularly to the longitudinal axis of the table leg and protruding from the table leg. In the position of use the connecting elements of the table legs are each connected with the ends of the crosspiece with two screw connections which are at a distance from each other in the longitudinal direction of the crosspiece, the screw elements being guided through a longitudinal slit of the connecting elements, which corresponds to their distance. Following the removal of the screw connections facing away from the ends of the crosspiece and loosening of the screw connections facing the ends of the crosspiece, the table legs can be folded into a storage position against the underside of the crosspiece, where they can be fixed in the storage position by tightening the screw connections facing the ends of the crosspiece.

The table legs are already assigned to the crosspiece in their correct position and, when placed perpendicularly with respect to the crosspiece and with the screw connections loosened, only need to be inserted into the crosspiece with their connecting elements and screwed to it with the further screw connections. This simple assembly work requires no special tools and can be performed by any non-specialist. Thus, when the table legs are in the storage position, the work surface and the frame with the crosspiece essentially determine the space requirements for storage and transport of the work table or office desk.

According to one preferred embodiment of this invention, the crosspiece is in the form of a U-shaped section with side legs and base leg. The connecting elements are screwed to the side legs of the crosspiece and the table legs are guided through cutouts in the ends of the base leg of the crosspiece. The table legs are optimally connected with the ends of the crosspiece, since the connecting elements are received in the crosspiece.

So that the use of the crosspiece as a cable conduit is not impaired, the connecting elements themselves are constructed as U-shaped sections with side legs and a base leg. The side legs of the connecting elements have aligned longitudinal slits and the base legs of the connecting elements have cutouts which, in the position of use of the table legs, coincide at least partially with the cutouts of the base leg of the crosspiece.

The stability and strength of the connections between the table legs and the crosspiece can be improved since the side legs of the connecting elements are each screwed to the adjacent side legs of the crosspiece with two screw connections, and the outer contour of the connecting elements is adapted to the receiving cross section of the U-shaped crosspiece.

In another preferred embodiment of this invention, the connecting elements are fixedly connected with the upper front faces of the table legs and terminate at a distance from the vertical outside of the table legs. The ends of the crosspiece are closed off by means of closing elements. The ends of the crosspiece can be closed off and the closing elements can be used for connection with a further work table or office desk.

A simple frame of low height in the storage position is obtained since the work surface is supported by four support arms which are hingedly positioned on the crosspiece and the underside of the work surface. The work surface can be changed in height and adjusted by using the support arms.

In accordance with a further embodiment, the sides of the table legs which extend perpendicularly to the longitudinal axis of the connecting elements are constructed as cable conduits with a U-shaped cross section, which can be closed off by covers.

This invention will be described in view of preferred embodiments illustrated in the drawings.

DESCRIPTION OF PREFERRED EMBODIMENTS

Figure 1:
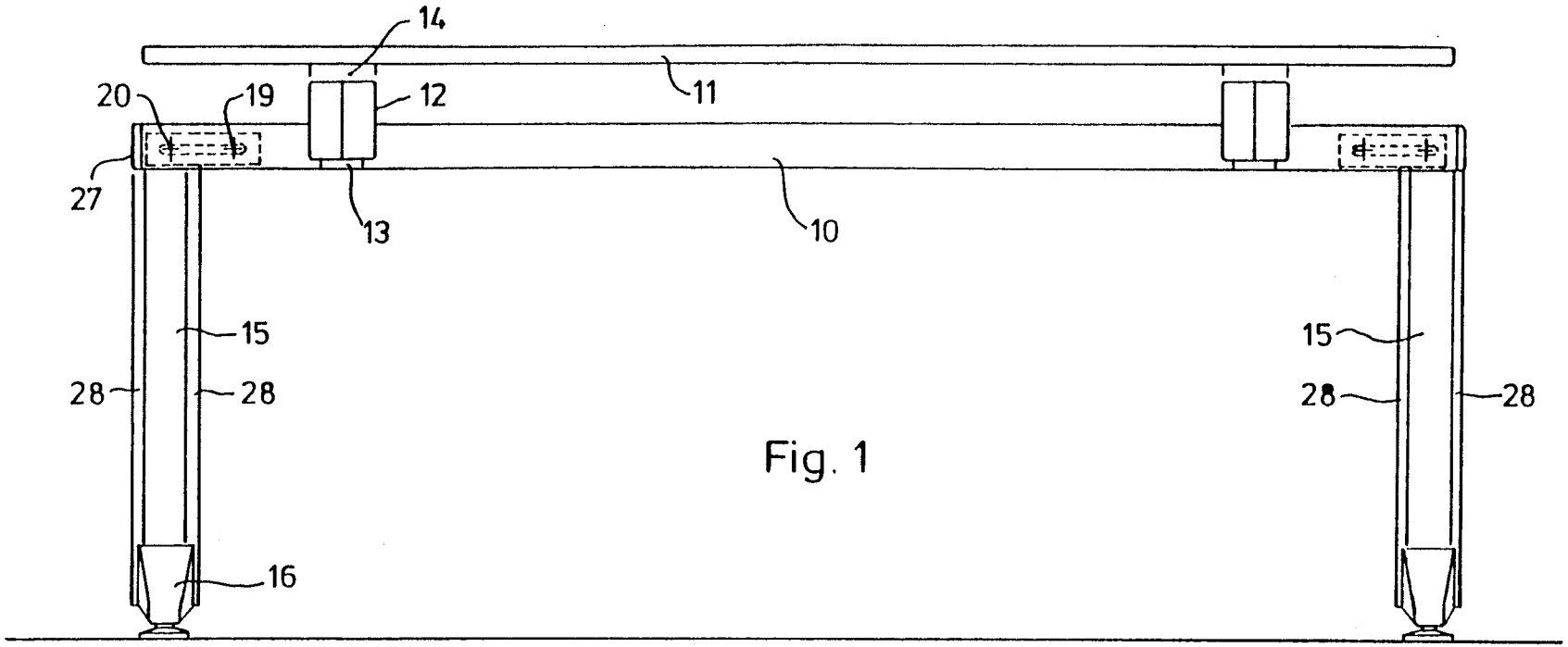
FIG. 1 is a side view of a work table or office desk in the position of use, according to one preferred embodiment of this invention.
Figure 2:
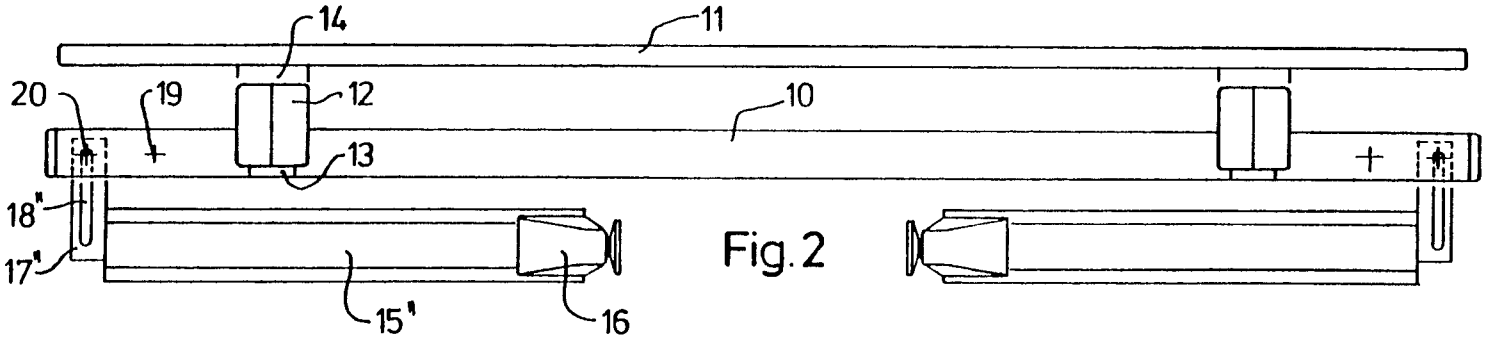
FIG. 2 is a side view of a work table or office desk in the storage position.

The crosspiece 10 is an essential element of the frame of the work table or office desk shown in FIGS. 1 and 2. Two support arms 12 are hinged to both long sides of the crosspiece 10 via bearing elements 13, which are oriented towards the front and back ends of the work surface 11. Bearing elements 14, on which the support arms 12 are hinged, are fastened to the underside of the work surface 11. The height of the work surface 11 can be changed and adjusted with these two pairs of support arms 12. The storage position in which the support arms 12 take up the lowest pivot position is illustrated.

A table leg 15, which supports a base element 16 extending towards the front and/or back of the work table or office desk, is attached to each end of the crosspiece 10.

Figure 3:
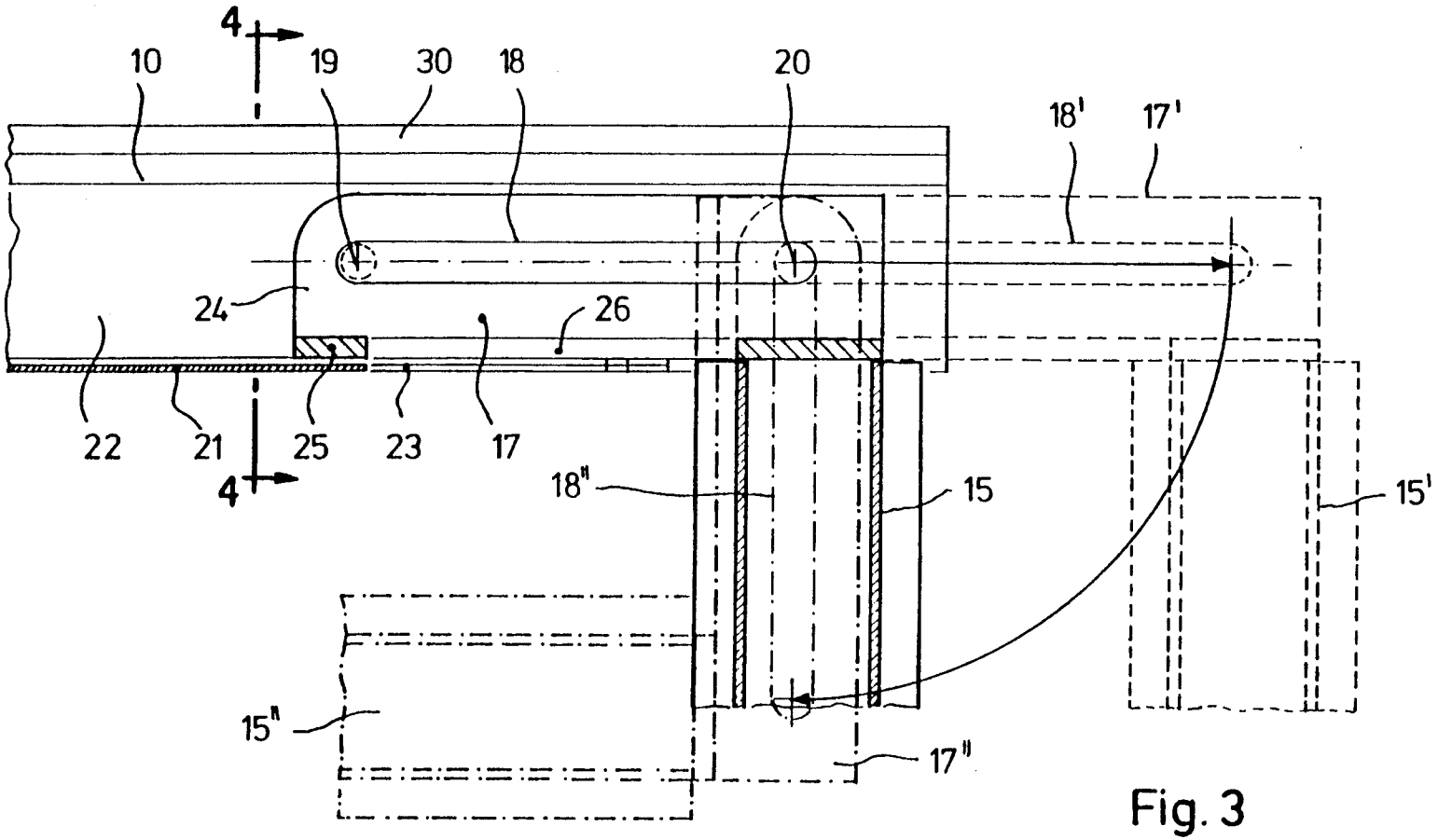
FIG. 3 in a enlarged partial cross-sectional side view of a connecting point between a table leg and the crosspiece.
Figure 4:
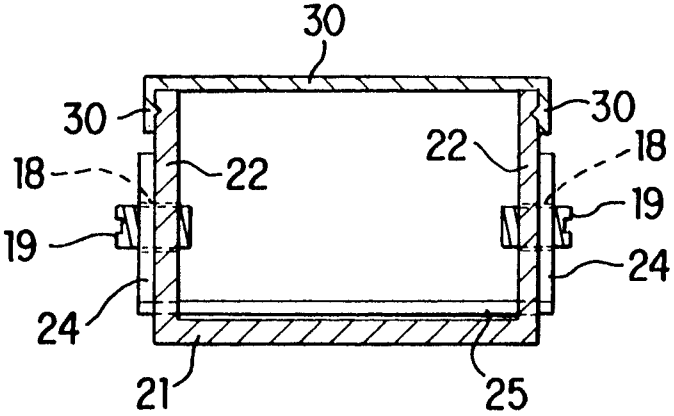
FIG. 4 is a diagrammatic sectional view taken along line 4—4 as shown in FIG. 3.

As shown in FIG. 3, a connecting element 17 is firmly attached to the upper end of the table leg 15, which is aligned perpendicularly to the longitudinal axis of the table leg 15 and protrudes on one side of the table leg 15. The crosspiece 10 is constructed as a cable conduit and in the embodiment shown comprises a section which is U-shaped in cross section, as shown in FIG. 3 and has the two side legs 22 and the base leg 21. The connecting element, 17 is also embodied as a U-shaped section, also as shown in FIG. 3 and adjusted with its exterior contour to the receiving cross section of the crosspiece 10 in such a way, that the side legs 24 of the connecting element 17 abut against the side legs 22 of the crosspiece 10.

The side legs 24 of the connecting element 17 have aligned longitudinal slots 18, through which the screw connections 19 and 20 are extended. The longitudinal slots 18 are adjusted to the distance between the screw connections 19 and 20. The end of the base leg 21 of the crosspiece 10 has cutout 23 through which the table leg 15 is extended. This cutout 23 is aligned with the cutout 26 in the base leg 25 of the connecting element 17, so that it is possible to introduce cables into the crosspiece 10. The table leg 15 forms a U-shaped cable conduit on the sides which are oriented perpendicularly to the longitudinal axis of the crosspiece 10, which can be covered by a cover 28. Cables can be routed upwards through these cable conduits of the table leg 15 and introduced through the cutout 23 in the crosspiece 10 and the cutout 25 in the connecting element 17 into the cable conduit formed by the crosspiece 10.

In the position of use, the screw connections 19 and 20 take up the end positions in the longitudinal slots 18, as shown in FIG. 3. Because each side leg 24 of the connecting element 17 is screwed by means of separate screw connections 19 and 20 to the facing side leg 22 of the crosspiece 10, the space between the side legs 24 of the connecting element 17 remains open for introducing cables.

If the screw connections 19 are unscrewed and the screw connections 20 are loosened, the table leg 15 with the connecting element 17 can be pulled out of the crosspiece 10 far enough so that the screw connections 20 abut against the other end of the longitudinal slots 18. This pulled-out position has been indicated by dashed lines, as can be seen from the reference numerals 15', 17' and 18'. The table leg can then be pivoted against the underside of the crosspiece 10 where, as indicated by 18'', the longitudinal slot 18'' is oriented downwards and the connecting element 17'' extends through the cutout 23. In this case, the table leg 15'' extends parallel to the crosspiece 10 and the table leg 15'' is arrested in the storage position by tightening the screw connection 20. Both table legs 15 are connected with the crosspiece 10 in the same way. The screw connections 19 can remain connected with the crosspiece 10, so that they are available when the table legs 15 are placed in the position of use.

Following the loosening of the screw connections 20, which are used as the pivot axle, the connecting element 17 can be re-inserted into the crosspiece 10 after having been pivoted up into the position 17'. The screw connections 19 are attached and the screw connections 20 tightened. The table legs 15 then take up a stable position of use.

As further shown in FIG. 3, the connecting elements 17 are connected with the upper front face of the table leg 15 in such a way that they have a defined distance with respect to the vertical outside of the table 15. When the connecting element 17 is connected with the crosspiece 10, the front face of the crosspiece 10 can be closed off by a closing element 27, which can also be used as a coupling element for connecting a further work table or office desk. The crosspiece 10 forms a continuous cable conduit which is not interrupted by the U-shaped connecting elements 17 at both ends and has access to the interior cable conduits of the table legs 15. The crosspiece 10 can be closed by means of a preferably lockable cover 30.

What is claimed is:

1. In a work table or office desk with a frame and a work surface supported by the frame, the frame having a horizontal crosspiece, ends of the horizontal crosspiece being connected with each of a plurality of table legs each provided with a base element, the improvement comprising:

upper ends of said table legs (15) facing said crosspiece (10), each said upper end being fixedly connected with a connecting element (17) extending perpendicularly to a first longitudinal axis of a corresponding said table leg (15) and protruding from said corresponding table leg (15), two screw elements (19, 20) for each said connecting element (17), in a position of use of the work table or office desk said screw elements (19, 20) positioned at a first distance from each other along a longitudinal direction of said crosspiece (10), each of said connecting elements (17) having a longitudinal slot (18), each of said screw elements (19, 20) mounted within said longitudinal slot (18) and secured to said crosspiece (10), following removal of said screw elements (19) facing away from said crosspiece ends and loosening of said screw elements (20) facing said crosspiece ends, said table legs (15) foldable into a storage position generally against a crosspiece underside of said crosspiece (10), said table legs (15) fixable in said storage position by tightening said screw elements (20) facing said crosspiece ends.

2. In a work table or office desk according to claim 1, wherein said crosspiece (10) is shaped as a first U-shaped section having two first side legs (22) attached to a first base leg (21), said connecting elements (17) are each screwed to one of said first side legs (22) of said crosspiece (10), a base leg end portion of each said first base leg (21) having a first cutout section (23), and said table legs (15) are guided through corresponding said first cutout sections (23).

3. In a work table or office desk according to claim 2, wherein said connecting elements (17) are constructed as second U-shaped sections each having two second side legs (24) attached to a second base leg (25), said longitudinal slots (18) of said second side legs (24) of each said connecting element (17) are aligned with each other, said second base legs (25) of said connecting elements (17) each having a second cutout section (26), and in said position of use of said table legs (15) each said second cutout section (26) at least partially coincides with a corresponding said first cutout section (23) of said first base leg (21) of said crosspiece (10).

4. In a work table or office desk according to claim 3, wherein said screw elements (19, 20) attach said second side-legs (24) of said connecting elements (17) to adjacent said first side legs (22) of said crosspiece (10), and an outer contour of each said connecting element (17) is adapted to a receiving cross section of said U-shaped crosspiece (10).

5. In a work table or office desk according to claim 4, wherein said connecting elements (17) are fixedly connected with upper front faces of said table legs (15) and terminate at a second distance from a vertical outside of said table legs (15), and said crosspiece (10) is closed off at opposing crosspiece ends with closing elements (27).

6. In a work table or office desk according to claim 5, wherein said work surface (11) is supported by four support arms (12) hingedly positioned on said crosspiece (10) and a surface underside of said work surface (11).

7. In a work table or office desk according to claim 6, wherein sides of said table legs (15) which extend perpendicularly to a connecting element longitudinal axis of said connecting elements (17) are constructed as cable conduits with a U-shaped cross section, which can be closed with covers (28).

8. In a work table or office desk according to claim 1, wherein said connecting elements (17) are fixedly connected with upper front faces of said table legs (15) and terminate at a second distance from a vertical outside of said table legs (15), and said crosspiece (10) is closed off at opposing crosspiece ends with closing elements (27).

9. In a work table or office desk according to claim 1, wherein said work surface (11) is supported by four support arms (12) hingedly positioned on said crosspiece (10) and a surface underside of said work surface (11).

10. In a work table or office desk according to claim 1, wherein sides of said table legs (15) which extend perpendicularly to a connecting element longitudinal axis of said connecting elements (17) are constructed as cable conduits with a U-shaped cross section, which can be closed with covers (28).

* * * * *